United States Patent [19]

Pierce

[11] Patent Number: 4,932,656

[45] Date of Patent: Jun. 12, 1990

[54] FOOT POSITIONING TRAINING AID

[76] Inventor: Richard A. Pierce, 1201 Morrison Ave., Houma, La. 70364

[21] Appl. No.: 411,222

[22] Filed: Sep. 22, 1989

Related U.S. Application Data

[63] Continuation of Ser. No. 135,988, Dec. 21, 1987, abandoned.

[51] Int. Cl.[5] ..... A63B 69/00

[52] U.S. Cl. ..... 273/26 R

[58] Field of Search ..... 273/26 A, 26 R, 29 A, 273/33, 181 A, 197 R, 197 A, 183 B, 183 A, 187 A, 187 B, 187 R, 195 R, 195 A, 195 B, 196, 29 C

[56] References Cited

U.S. PATENT DOCUMENTS

| | | | |
|---|---|---|---|
| 3,342,487 | 9/1967 | David | 273/26 R |
| 3,363,903 | 1/1968 | O'Brien | 273/187 B |
| 3,815,906 | 6/1974 | Hermo | 273/26 R |
| 3,955,821 | 5/1976 | Spedding | 273/187 B |
| 3,979,116 | 9/1976 | Matchick | 273/26 R |
| 4,023,810 | 5/1977 | Lorang | 273/187 B |
| 4,101,130 | 7/1978 | Richards | 273/187 A |
| 4,146,231 | 3/1979 | Merkle et al. | 273/195 B |
| 4,194,735 | 3/1980 | Wilson | 273/26 R |
| 4,225,133 | 9/1980 | Kiray | 273/26 R |
| 4,226,420 | 10/1980 | Cordy | 273/DIG. 30 |
| 4,331,332 | 5/1982 | Hughes | 273/195 B |
| 4,387,896 | 6/1983 | O'Brien | 273/187 B |
| 4,516,772 | 5/1985 | Stratton | 273/26 R |
| 4,664,375 | 5/1987 | Tetreault | 273/26 E |

*Primary Examiner*—T. Brown

*Attorney, Agent, or Firm*—Fleit, Jacobson, Cohn, Price, Holman & Stern

[57] ABSTRACT

A foot positioning training aid for training and instructing individuals in the proper positioning of their feet when engaged in various activities in which the position and movement of the feet are critical to proper execution of desired functions. The training aid includes a generally rectangular panel which can be supported on various supporting surfaces and is provided with a raised rear edge portion and raised side edge portions to position the feet but not form barriers to movement. The side edges of the training include progress numerical indicia and VELCRO alongside of the indicia together with positionable indicators on the VELCRO to provide indicators for initial position of the feet and also indicators to indicate movement or secondary positions of the feet for optimum performance of certain functions.

7 Claims, 2 Drawing Sheets

FIG. 4
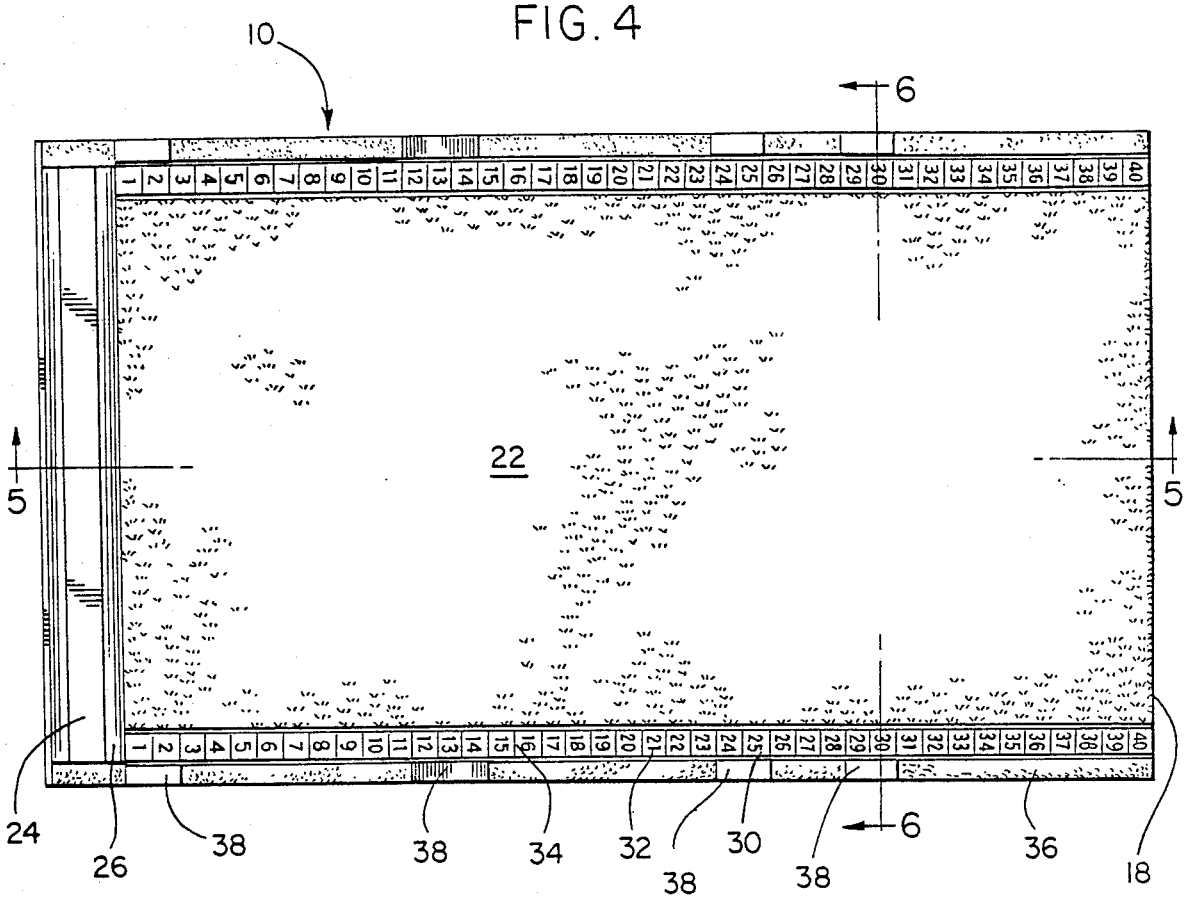
FIG. 5
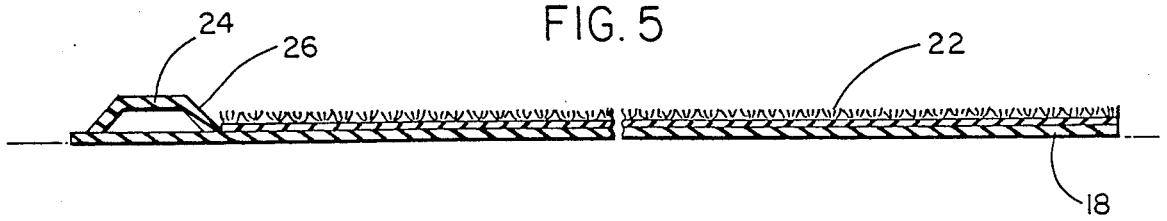
FIG. 6
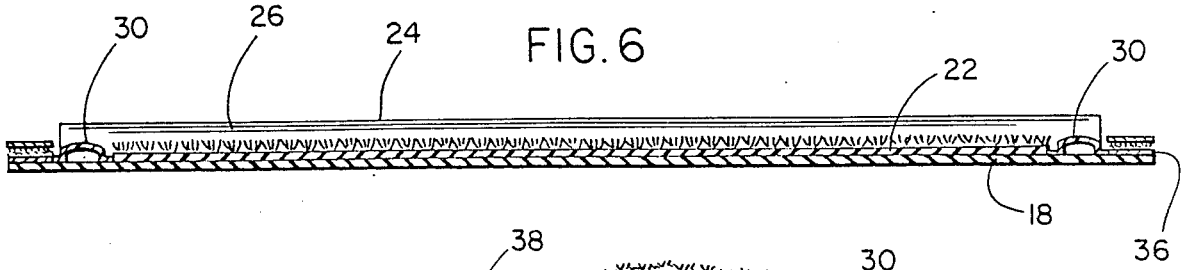
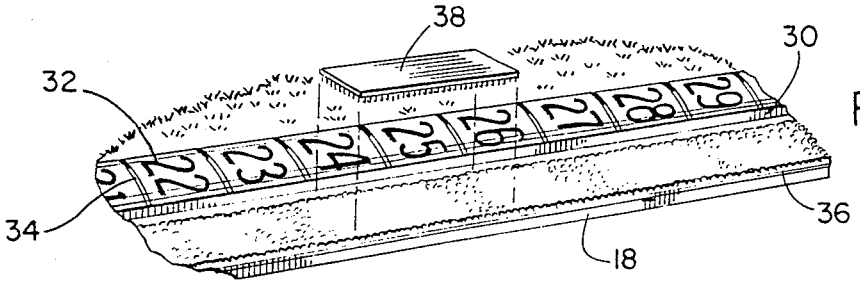
FIG. 7

FOOT POSITIONING TRAINING AID

This application is a continuation of application Ser. No. 07/135,988, filed Dec. 21, 1987 (now abandoned).

BACKGROUND OF THE INVENTION

1. Field of the Invention

The present invention generally relates to a foot positioning training aid for training and instructing individuals in the proper positioning of their feet when engaged in various activities in which the position and movement of the feet are critical to proper execution of desired functions. The invention has particular utility for training individuals engaged in athletic activities such as moving or positioning a bat to engage a thrown ball, positioning and swinging a golf club to strike a stationary golf ball, positioning a racquet for optimum engagement with an approaching ball or other projectile and other similar activities. The training aid includes a generally rectangular panel which can be supported on various supporting surfaces and is provided with a raised rear edge portion and raised side edge portions to position the feet but not form barriers to movement. The side edges of the training include progressive numerical indicia and VELCRO alongside of the indicia together with positionable indicators on the VELCRO to provide indicators for initial position of the feet and also indicators to indicate movement or secondary positions of the feet for optimum performance of certain functions. The disclosure in this application relates to training a batter in striking a ball with a bat by instructing the batter in various proper batting techniques.

INFORMATION DISCLOSURE STATEMENT

There have been provided many devices to assist in training individuals in hitting a baseball, softball or the like, properly striking a golf ball, swinging a tennis racquet and the like. While such devices have accomplished beneficial results to some extent, none of the previously known devices utilize the structural arrangement of this invention and none of the devices utilize the same technique as this invention. A separate information disclosure statement will be filed.

SUMMARY OF THE INVENTION

An object of the present invention is to provide a foot positioning training aid for use in training individuals to properly position their feet when engaged in various activities and which includes a flat panel supported on a support surface and having an upper surface to be engaged by the feet of a person being trained together with position indicating arrangements associated with the panel to provide instructions to an individual as to optimum foot position and optimum foot movement when participating in certain activities.

Another object of the invention is to provide a training aid in accordance with the preceding object in which the panel is of rectangular configuration and the indicating arrangements include an upstanding edge element along one end edge and two side edges of the panel combined with numerical indicia and VELCRO strips adjustably and detachably receiving VELCRO indicators to indicate the position of the feet of an individual at a starting point and to indicate movement of one or both feet and a subsequent position of the feet during a particular activity.

A further object of the invention is to provide a training aid in accordance with the preceding objects which is especially useful in instructing individuals in proper foot positions when using a bat to bat a baseball, softball and the like with the training aid also being useful in training individuals in other sports, athletic endeavors or other endeavors in which foot position and foot movement are critical to optimum performance of such activities.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a perspective view illustrating the invention used when training an individual in bunting a baseball or the like.

FIG. 4 is a top plan view of the training aid.

FIG. 5 is a longitudinal, sectional view, on an enlarged scale, taken along section line 5—5 on FIG. 4.

FIG. 6 is a transverse, sectional view taken along section line 6—6 on FIG. 4.

FIG. 7 is a fragmental perspective view, on an enlarged scale, illustrating the specific structural details of a side edge portion of the training aid.

DESCRIPTION OF THE PREFERRED EMBODIMENT

Figure 1:
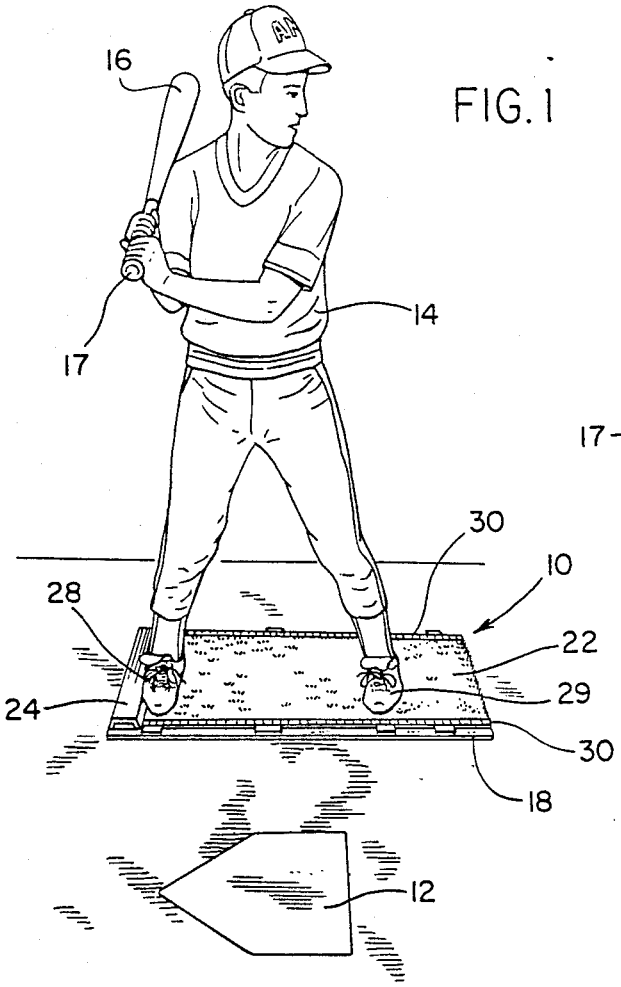
FIG. 1 is a perspective view of the foot positioning training aid of the present invention when used in training an individual in batting a thrown ball.

Referring now specifically to the drawings, the foot positioning training aid of the present invention is generally designated by reference numeral 10 and in the embodiment disclosed, it is associated with a conventional home plate 12 used in baseball or softball and is used to train an individual batter 14 in various phases of using a baseball bat 16 to hit a baseball that is thrown over home plate 12 in a manner described in more detail hereinafter.

The training aid 10 includes a rectangular panel 18 constructed of rubber, plastic or other material which can be positioned on a supporting surface 20 such as the ground surface, the floor of a gymnasium or any other surface area which is generally flat. The panel 18 is provided with an upper surface 22 that may be in the form of artificial turf or the like or other material that is cleat proof so that the individual 14 wearing cleated baseball shoes may effectively stand on the panel 18. While dimensions may vary to some extent, the panel 18 is solid rubber and may have dimensions of ¾" thickness, 24" width and 42" length with the device being somewhat flexible but still capable of being self supporting on the supporting surface 20.

Along one end edge of the panel 18, a raised end element 24 is attached which is generally an inverted channel shaped rubber member or it may be a solid rubber member 24 having inclined side walls 26 at approximately 45° to the surface of the panel 18 as illustrated in FIG. 5 which forms a positioning device for the rear foot 28 of an individual batter 14 when batting right handed is illustrated in FIG. 1.

Each side edge of the panel 18 is provided with a side edge raised element 30 of generally inverted channel shaped configuration with the upper surface thereof being generally transversely arcuate and provided with numerical indicia printed thereon, formed thereon or otherwise applied thereto as indicated by reference numeral 32 with the numerical indicia 32 increasing from number 1 adjacent the end element 24 to the number 40 at the opposite end edge of the panel with the indicia 32 including transverse division lines 34 spaced at 1" increments or at some other equal spacing.

As illustrated, the side edge raised elements 30 are spaced inwardly from the side edges of the panels approximately two inches with a VELCRO strip 36 being provided on the panel 18 outwardly of the raised side edge elements 30 as illustrated in FIGS. 4, 6 and 7 with the upper surface of the VELCRO strip 36 being spaced slightly below the upper surface of the raised side edge element 30 to provide some protection for the VELCRO strip 30 which can be secured to the panel 18 in any suitable manner such as by bonding or the like.

Releaseably and movably positioned on the VELCRO strip is a plurality of indicator strips 38, which are a rectangular configuration and which have matching VELCRO material on the undersurface thereof for detachable mounting and adjustable mounting on the VELCRO strips 36. The hook and loop pile formed respectively on the strip 36 and the shorter strips 38 represent conventional fastener materials which are well known and enable the indicator strips 38 to be positioned at desired positions along the length of either of the VELCRO strips 36. By providing VELCRO strips 36 along both edges of the panel 18, the training aid 10 can be used on either side of home plate 12 to enable left-handed and right-handed batters to use the device. The VELCRO strips 36 are approximately 2" in width and extend throughout the length of the side edge of the panel 18 as illustrated in FIG. 4 with the side edge raised elements 30 being approximately 2" wide and 2" high and 39" in length since these elements terminate at the forward edge of the end raised element 24 as illustrated in FIG. 5. All of these components may be constructed of rubber, plastic or similar material with the VELCRO strips 36 and 38 being of conventional construction and provided with a flexible backing with the loop and pile material thereon to enable the VELCRO strip 36 to be easily bonded to the panel 18 and to enable the strips 38 to be distinguishably colored. In the preferred embodiment, there are four strips 38 each of which may be 4" in length or any other desired length and have a width equal to or greater than the width of the VELCRO strips 36 with three of the indicator strips 38 being one color such as grey and the other indicator strip 38 being a different distinguishable color such as red to facilitate positioning of these strips and provide observable significance to them which can be readily recognized by the individual being trained.

The five components of the present invention are easily usable and are relatively inexpensive. The panel 18 is of non-skid rubber or plastic material covered with a cleat proof surface with the raised edge elements being of solid or hollow rubber or plastic material and the VELCRO strip 36 and indicator VELCRO strips 38 being commercially available items.

The side edge elements 30 and the numerical indicia 32 thereon provide reference to a starting point and/or placement of both feet 28 and 29 when a batter is in the set position so that the hitter or batter may place the indicator strips 38 at precisely the same point or position each time that he takes a batting stance. This also provides the batter or hitter with a reference point as to the location of his feet during the stride and during each phase of hitting. Thus, the hitter will always place his feet in the same position and stride precisely in the same manner each time he hits which is important in learning his strike zone and training his body in a neuromuscular manner to react to a ball being thrown across home plate with precise timing and accuracy each time.

Figure 2:
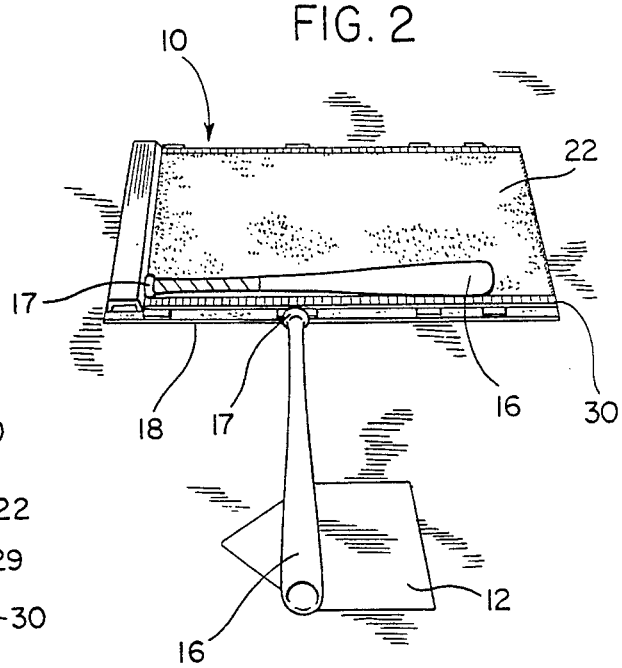
FIG. 2 is a perspective view of the invention illustrating the manner in which it is initially positioned with respect to a home plate.
Figure 3:
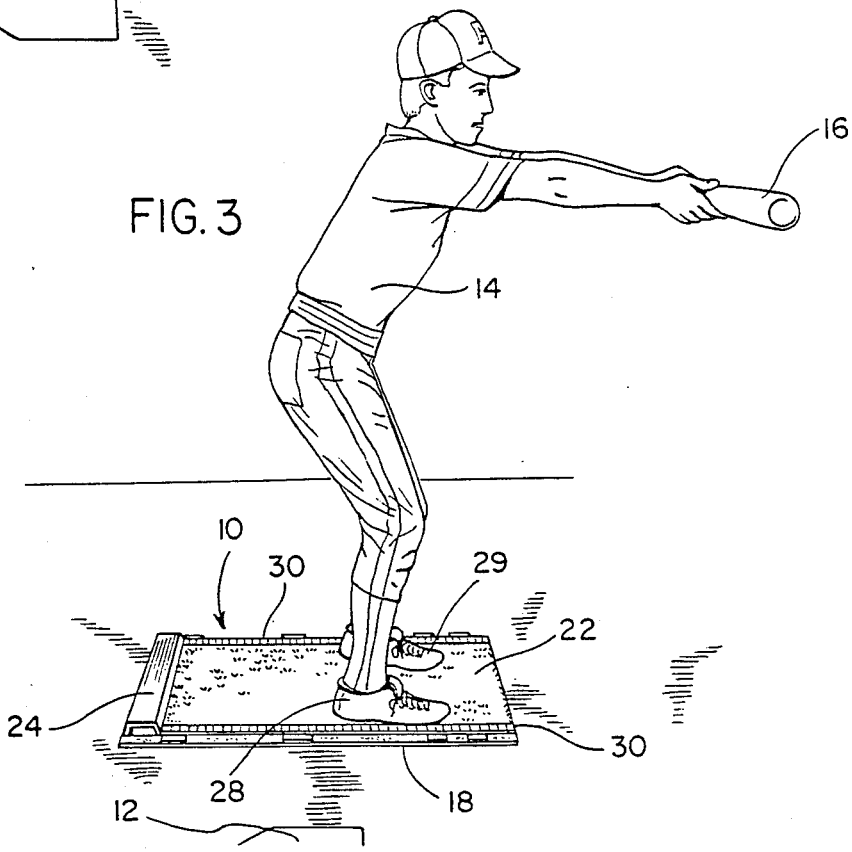

FIG. 2 illustrates the placement of the training aid in reference to home plate 12 which also must be precisely set at the same place during each practice. The training aid is positioned by the hitter placing his bat 16 perpendicular to the outside edge of the plate 12 at a point 8½ inches from the front edge where the plate begins it break to the back point. The training aid 10 is then placed on the ground next to the knob 17 on the handle of the bat 16 with this line defined by the bat 16 being oriented perpendicular to the side edge of the training aid 10 and the bat 16 can also be used to adjust the training aid with respect to the length of the bat which occurs when the hitter places his bat 16 so that the knob 17 rests against the inclined edge 26 of the end member 24 in parallel relation to the side edge member 30 as illustrated in FIG. 2. One grey indicator strip 38 is then placed where the handle hits element 24 and another indicator strip is placed to the inside edge of the barrel of the bat and the red indicator strip 38 is placed directly between the two grey indicator strips and is lined up perpendicular to the line formed by the bat 16 when it is positioned across home plate in the manner indicated in FIG. 2. Thus, the red indicator strip will serve as a guideline for the placement of the hitter's head when in the normal batter's stance as illustrated in FIG. 1 since it is most important that the head does not move during the attempt to hit the ball inasmuch as improper movement of the head either up, down, in or out or front-to-back is caused by improper control of the body weight shift during the swing. The red indicator strip 38 positioned as illustrated in FIG. 2 will aid the hitter in keeping the head positioned over the center of gravity during the swing. The third grey strip 38 is then placed 4" in advance of the second grey strip as illustrated in FIG. 2. Thus, the purpose of the four indicator strips include marking the precise place where the hitter 14 will place his rear foot when taking his place in the simulated batter's box formed by the training aid. The second grey indicator strip will mark the precise place where the hitter will place his striding foot 29 when taking his stance and the third grey strip will indicate the precise place where the hitter should stride with his striding foot 29 with each pitch. Thus, the training aid puts the hitter at exactly the same place each time he steps to home plate.

One key factor in hitting is the hitter avoiding a swing at a pitch outside of the strike zone. The present invention allows the hitter to learn his strike zone quickly and aid him in disciplining himself to swing only at strikes. Prior to entering the batter's box during a game, the hitter is allowed to take preliminary swings at the designated on-deck circle which enables the hitter to get his timing with respect to the pitcher with the hitter preparing himself mentally and physically to hit the ball. The present invention can be used as an on-deck circle during regulation games.

Hitting a baseball may be separated into five steps, namely, stance, ready, tracking (hip turn), trigger and follow through and the present invention aids to teach proper techniques and correct common faults in each phase of hitting. At the stance phase, the hitter's toes should be aligned with the raised side element 30 which eliminates open and closed stances and allows the hitter to hit both inside and outside pitches. In an open stance, the hitter sometimes has problems with an outside pitch because the body motion seems to make the plate move away. In a closed stance, the hitter sometimes has problems with an inside pitch because the body motion causes to the plate to seem to move away. The placement of the rear foot 28 is the key to hitting to all fields. If the toes are placed perpendicular to the plate, the hitter will hit through the middle of the diamond most of the time but if the toes are pointed towards the catcher, the ball will be hit to the opposite field most of the time and if the toes are pointed towards the pitcher, the ball will be pulled most of the time. The raised end element 24 will make the hitter aware of his rear foot placement each time he steps into the batter's box. The knees are bent and positioned on the inside of both feet with the end element 24 being used by the hitter to assure proper weight distribution on the ball of the rear foot. Also, the end element 24 forces the hitter to shift his weight forward during the swing so that the heel on the rear foot can clear the element 24 during hip rotation. Also, the feet should be spread comfortably with the toes of the lead foot pointed perpendicular to the pitcher some four to six inches short of the bat length. The hips and shoulders should be level with the ground and the bat should be held in the fingers of both hands with the knuckles of both hands lined up in order to unlock the wrists and elbow joints with the bat held from perpendicular to 45° with respect to the ground. The arms are cocked with the hands and wrists relaxed and held over the rear foot in a manner by which the hands will come through first. The wrists of both hands should not roll below a straight line when the arm is extended parallel to the ground. Also, the head should be upright with the chin over the front shoulder and above the body, the eyes should be level with both of them looking at the point of release of the pitch and the elbow joints should be very relaxed and pointing towards the ground. The training aid of this invention thus aids in proper stance of the hitter preparatory to swinging and during the swing of the bat.

In the ready position in which the hands are cocked back and the front foot stride occurs as the pitcher reaches his ready position, the hitter's lead shoulder and chin should make contact and the bat is also brought into contact with the rear shoulder which helps the hitter to be aware of the location of the body parts prior to the swing and to aid in body part timing with the swing. As the hitter cocks his shoulders back, he will begin his stride position with about 60% of his body weight shifted to his back foot. The weight should remain in this distribution until after the striding foot hits the ground. The hitter should stride directly to the pitcher and try to hit the ball through the middle. The training aid of this invention prevents an incorrect stride since the hitter cannot stride closed, opened or over stride. Also, the invention enables the hitter to discipline himself so that the striding foot remains closed with both knees pointing towards the plate until the important hip turn begins with the knees kept between the feet, the hands and back of the rear foot, the waist, shoulders and eyes kept level, the chin over the lead shoulder until after the stride is complete and hips begin to open then maintaining the lead arm so that it does not straighten or lock-out, which causes loss of speed and power with the forearm of the bottom hand being held parallel to the ground and parallel to the level shoulders with the bat barrel remaining up and above the hands. The stride remains the same whether the pitch is an inside pitch, outside pitch or over the plate with the hip turn and movement of the hands differing with each pitch.

The tracking phase is aided by this invention so that when the hip and legs are committed to the ball, they will initiate movement of the hands to the ball. The hip begins the move and must clear the way for the hands with the arms, hands, wrists and elbows not moving toward the ball during tracking. Also during tracking, the bat will remain in contact with the rear shoulder, the head and chin remains still and down, the hips begin to turn towards the ball and weight begins to be shifted forward to the front leg, the knees begin to turn with the back knee initiating the move, the back hip pops forward with the arms remaining cocked until the hips clear so that power is obtained from the weight shift thereby avoiding the biggest fault of movement of the arms or upper body during hip turns. The barrel of the bat must remain up during the beginning of the hip turn with the hip tracking and turning according to the location of the pitch since the hips will not turn as much on an outside pitch as they would on an inside pitch.

The trigger phase, which is a commitment of the hands and arms to the ball, is assisted by the present invention with both elbows down, bent, compact and close to the body until the hips clear with both hands being thrown toward the ball as the body weight completes its shift to the front leg with the lead arm extending to form a straight line with the bat. At contact with the ball, the barrel of the bat should be above the hands and the hands above the ball and the hands at the point of contact will be palm down for the lead hand and palm up for the trailing hand and the back arm should lock out just after contact. Both arms will then be extended to form a triangle after contact and for maximum force, the head and eyes should remain down and the chin looking over the rear shoulder after rotation, that is, the shoulder and lower body will rotate but the head remains still.

The follow-through position includes the rolling of the wrist after the triangle is formed with the knees being between both feet during the follow-through. The bat should end up at approximately the opposite position from where it started and the head should remain still during the entire swing, which can be checked during training by using the red indicator strip 38 to determine if the head of the hitter is in line with that strip after each swing. As soon as the ball is hit, the hitter becomes a runner and the training aid of this invention allows the hitter to practice his running to first base with maximum effort each time he hits a ball.

The invention also assists in training a hitter in bunting techniques for all major types of bunts in which common positions are used. The body must be aligned with the plate, which is accomplished by the feet of the bunter being positioned with respect to the side elements and the bat must be held at the top of the strike zone and must be balanced to prevent the ball from being popped up. The bat must be placed in fair territory, forwardly of home plate, to prevent the ball from going foul. The hitter should only attempt to bunt strikes and must run full speed to first base after execution of the bunt. The training aid of the present invention enables practice of bunting techniques including positioning of the batter, the bat and reacting to pitches in the strike zone and running to first base.

While the invention has been specifically described with respect to baseball, it also can be used with softball and may also be used with other athletic activities including golf, tennis, and other activities in which the initial position and subsequent movement of the feet are important and in which it is important to locate and position the feet precisely during each training session.

Among some of the advantages and benefits derived from the use of the training aid of the present invention includes teaching hitters to stride closed with the lead foot so that lower body power is stored until the hips turn, provide adjustment of components to allow for individual batting styles, elimination of obstacles that would distract or hinder a stride during batting practice, eliminate mechanical devices which could hang up or break and possibly cause injury, provide adjustment to match individual striding style and distance, enable a hitter to place the rear foot where desired in order to dictate where the ball will be hit, enable adjustment of the batter's box in relation to home plate for each hitter with the length of the bat determining this distance and permit the batter to repetitively reproduce precisely all aspects of hitting until a desired level of skill is attained.

In addition, the device allows a hitter to practice hitting a ball off a tee, practice in any outside or inside area, enable a hitter to align himself with home plate with his center of gravity in alignment with the plate, place his head in line with home plate, enable the hitter to concentrate totally on hitting the ball and which will serve both right-handed and left-handed hitters. Essentially, this device can be used in training all aspects of an individual developing proper techniques for optimum contact with a ball by a hand manipulated implement.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A foot positioning training aid comprising a panel adapted to be positioned on a supporting surface and including a generally planar upper surface, guide elements positioned along a portion of the periphery of the panel for indicating the position of the feet of an individual using the training aid and means adjustably mounted on a portion of the peripheral edge of the panel to indicate initial position of the feet and subsequent position of the feet during a cycle of movement of an individual when performing a function, said panel being generally rectangular with the upper surface receiving the feet of an individual using the training aid, said guide elements including a raised end member at one end of the panel and raised side elements along opposite sides of the panel to enable the panel to be reversed for use by left-handed and right-handed individuals.

2. The structure as defined in claim 1 wherein the end element and side elements are vertically shallow so they do not form total barriers to movement of the feet of the individual.

3. The structure as defined in claim 2 wherein said raised side elements include numerical indicia arranged progressively thereon to provide precise indication of feet location in an initial position and feet location during a subsequent position with respect to the lengthwise dimension of the side edge of the panel.

4. The structure as defined in claim 3 wherein said indicator means includes an elongated side edge portion of the panel oriented outwardly of the raised side elements and distinguishable indicator members longitudinally adjustably positioned on the side edge portion of the panel oriented outwardly beyond the raised side elements.

5. The structure as defined in claim 4 wherein the side edges of the panel outwardly of the raised side elements include continuous VELCRO material and each indicator member includes a strip of VELCRO material for adjustably positioning the indicator members on the panel with the indicator members being distinguishably colored to enable visual observation to facilitate location of the feet in relation to the indicator members.

6. In combination, a home plate over which a pitched ball is to pass and alongside which a batter stands to swing or position a bat with the intention of batting or bunting the pitched ball with the bat, a training aid for instructing a batter in optimum foot positioning in relation to home plate when batting or bunting the ball with a bat, said training aid comprising a panel having a generally planar upper surface, said panel having a side edge positioned alongside home plate in generally parallel relation thereto, said panel including a raised end element perpendicular to the side edge and forming a guide for positioning the back foot of a batter in optimum relation to home plate when swinging a bat across home plate, and means on the side edge of said panel to indicate the initial and final position of the stride foot when batting a ball, said indicator means including longitudinally adjustable indicators detachably mounted on said side edge to indicate the initial and final position of the stride foot for individuals having different stride characteristics.

7. The structure as defined in claim 6 wherein said panel includes a second side edge, said side edges being in spaced parallel relation to enable the panel to be positioned along either side of home plate for use by right and left handed batters.

* * * * *